United States Patent [19]

Sakurai et al.

[11] Patent Number: 4,762,478

[45] Date of Patent: Aug. 9, 1988

[54] SCROLL COMPRESSOR WITH BALANCER MOUNTED IN SINGLE FRAME

[75] Inventors: Kazuo Sakurai, Ihara; Takahiro Tamura, Shimizu, both of Japan

[73] Assignee: Hitachi, Ltd., Tokyo, Japan

[21] Appl. No.: 63,923

[22] Filed: Jun. 19, 1987

[30] Foreign Application Priority Data

Jun. 23, 1986 [JP] Japan ..... 61-144873

[51] Int. Cl.[4] ..... F04C 18/04; F04C 29/00

[52] U.S. Cl. ..... 418/55; 418/151; 29/156.4 R

[58] Field of Search ..... 418/55, 151; 29/156.4 R

[56] References Cited

U.S. PATENT DOCUMENTS 4,065,279 12/1977 McCullough ..... 418/55

4,621,993 11/1986 Nakamura et al. ..... 418/55

FOREIGN PATENT DOCUMENTS 61-8401 1/1986 Japan ..... 418/55

*Primary Examiner*—John J. Vrablik

*Attorney, Agent, or Firm*—Antonelli, Terry & Wands

[57] ABSTRACT

A scroll compressor is disclosed. A first main bearing and a second main bearing is coaxially formed on the sole frame but a balancer can be easily attached to a drive shaft by forming a space and an opening in the frame of the scroll compressor. The balancer is inserted through the opening formed in the periphery of the frame. One end of the drive shaft is inserted in the hole of the balancer and the first and second main bearings. The drive shaft and the balancer are fixed by suitable fixing means, so that the drive shaft is rotatably supported by the first and second main bearings, and the balancer can be rotated together with the drive shaft. Accordingly, since the frame of this invention has a single, integral frame structure, it is possible to coaxially form the first main bearing and the second main bearing, both of which are mounted on the frame.

3 Claims, 4 Drawing Sheets

SCROLL COMPRESSOR WITH BALANCER MOUNTED IN SINGLE FRAME

BACKGROUND OF THE INVENTION

1. FIELD OF THE INVENTION

The present invention relates generally to a scroll compressor and, more particularly, to a frame structure which can be easily assembled by improving the manner of attaching a balancer to the frame structure.

2. DESCRIPTION OF THE PRIOR ART

In a conventional low-pressure chamber type of scroll compressor, as described in U.S. Pat. No. 4,065,279, a balancer attached to the drive-shaft side is disposed between a first frame having a bearing portion for rotatably supporting the shaft provided at the back of the base plate of an orbiting scroll and a second frame constituted by a main bearing for rotatably supporting a lower drive shaft and a leg portion to which a motor is fixed, the first and second frames being formed separately from each other. In such a structure, although the assembly of the balancer is easy, two such separate frames are needed, and thus no account is taken of the fact that it is necessary to coaxially assemble the bearing for rotatably supporting the first frame and the main bearing for rotatably supporting the lower drive shaft provided in the second frame.

The aforesaid prior art adopts a structure in which two main bearings are respectively provided in the separately-formed frames in order to give a preference to the manner of attachment of the balancer, but takes no consideration into the aforementioned coaxial assembly of the first and second main bearings. Therefore, when it is necessary to minimize eccentricity which might take place during assembly, a severe working accuracy is required, and this makes the working process difficult and complicated. Accordingly, since the two drive-shaft bearing portions may be assembled in an eccentric state, the drive-shaft bearings would partially strike other adjacent components, thereby causing various problems concerning reliability, for example, the bearings being burnt or damaged.

SUMMARY OF THE INVENTION

It is therefore an object of the present invention to provide a frame structure of a scroll compressor which has the sole frame in which two main bearings are worked in coaxial relationship, a space for receiving a balancer being formed between the two main bearings.

BRIEF SUMMARY OF THE INVENTION

The above-described object is achieved by the present invention which provides a scroll compressor including: a scroll compressor portion including an orbiting scroll and a fixed scroll each having a base plate on which a spiral-shaped wrap is vertically formed, the orbiting scroll and the fixed scroll being combined such that the respective wraps are engaged with each other, in which orbiting motion is imparted to the orbiting scroll to cause an airtight space formed by the base plates and wraps of the respective scrolls to move toward the center of the orbiting motion to progressively reduce the volume of the airtight space thereby performing compression; a drive shaft for connecting the scroll compressor portion and a motor; and a frame including bearings for rotatably supporting the drive shaft, the frame being disposed between the scroll compressor portion and the motor for providing fixed connection therebetween, the frame being accommodated in a casing of the scroll compressor, wherein the improvement comprises: the frame constituted by a single frame on which a first main bearing portion and a second bearing portion may be formed in coaxial relationship; a balancer mounted on the drive shaft as a main shaft rotatably supported by the first and second shaft bearing portions to form a space-like chamber which is rotatable in the portion of the frame near the first main bearing and defined between the first and second shaft bearing portions; and an opening formed in the periphery of the frame and communicating with the spacelike chamber, the balancer being freely inserted and extracted through the opening.

Also, the opening formed in the periphery of the frame may be disposed at two locations symmetrical with respect to the axis of the drive shaft.

The aforesaid object is further achieved by providing a scroll compressor for an air conditioner serving as a refrigeration cycle which employs a scroll compressor including: a scroll compressor portion including an orbiting scroll and a fixed scroll each having a base plate on which a spiral-shaped wrap is vertically formed, the orbiting scroll and the fixed scroll being combined such that the respective wraps are engaged with each other, in which orbiting motion is imparted to the orbiting scroll to cause an airtight space formed by the base plates and wraps of the respective scrolls to move toward the center of the orbiting motion to progressively reduce the volume of the airtight space thereby performing compression; a drive shaft for connecting the scroll compressor portion and a motor; and a frame including bearings for rotatably supporting the drive shaft, the frame being disposed between the scroll compressor portion and the motor for providing fixed connection therebetween, the frame being accommodated in a casing of the scroll compressor, wherein the improvement comprises: the frame constituted by a single frame on which a first main bearing portion and a second bearing portion may be formed in coaxial relationship; a balancer mounted on the drive shaft as a main shaft rotatably supported by the first and second shaft bearing portions to form a space-like chamber which is rotatable in the portion of the frame near the first main bearing and defined between the first and second shaft bearing portions; an opening formed in the periphery of the frame and communicating with the space-like chamber, the balancer being freely inserted and extracted through the opening; and a pressure equalizing hole formed passing through the frame for equalizing the respective pressures in the space-like chamber, a back chamber provided at the back of the orbiting scroll, and the casing thereby providing communication between the casing and a lower-pressure side of the refrigeration cycle.

DESCRIPTION OF THE PREFERRED EMBODIMENTS

Figure 1:
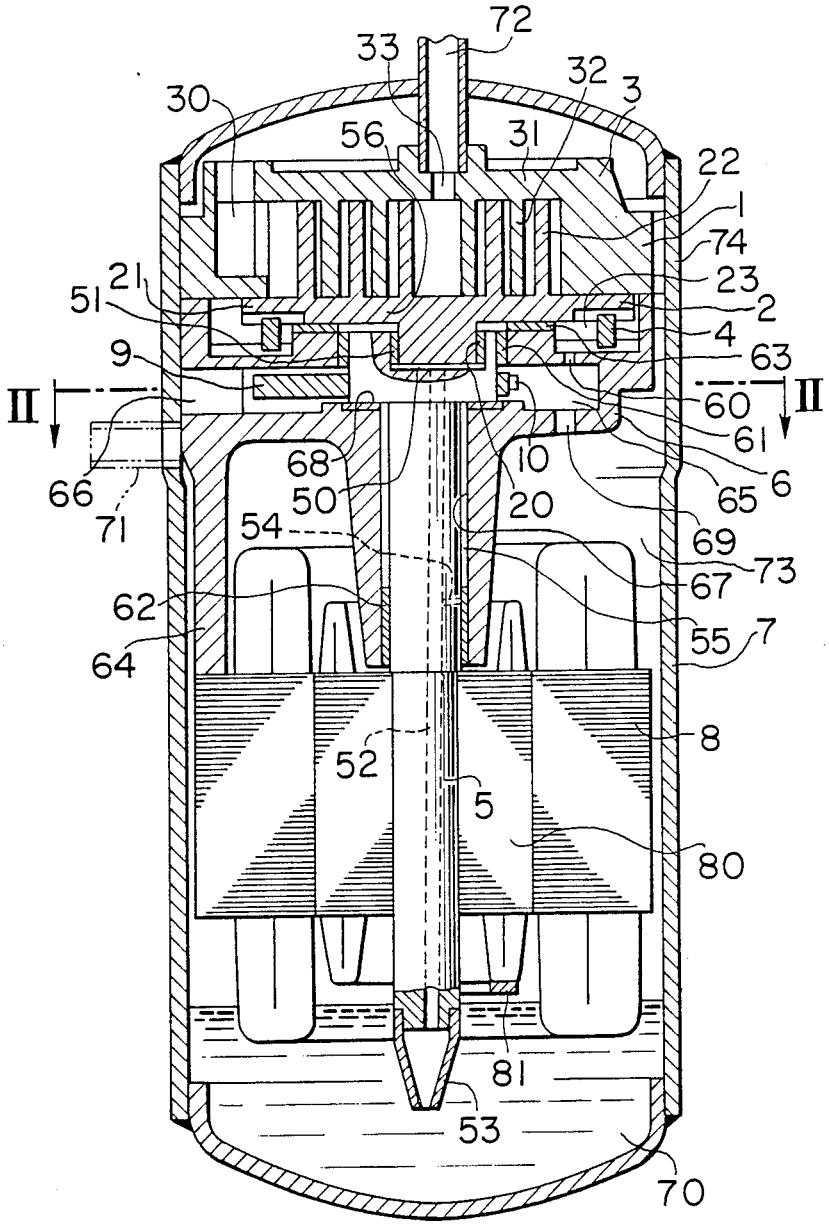
FIG. 1 is a diagrammatic sectional view of a preferred embodiment of the present invention.
Figure 2:
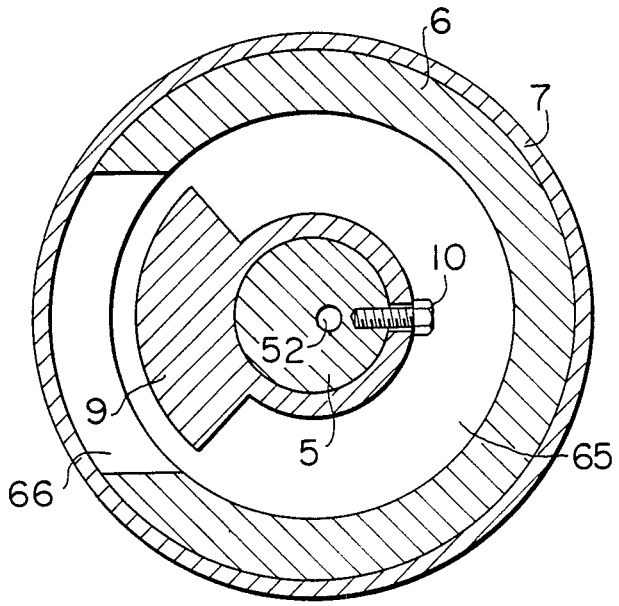
FIG. 2 is a sectional view taken along the line II—II of FIG. 1.

A first preferred embodiment of the present invention will be described below with reference to FIGS. 1 and 2. FIG. 1 diagrammatically shows the entire construction of a scroll compressor to which the present invention is applied, and FIG. 2 is a sectional view taken along the line A—A of FIG. 1.

A scroll compressor portion 1 includes an orbiting scroll 2 and a fixed scroll 3, the scroll 2 being meshed with the scroll 3. The scroll compressor portion 1 is connected to a drive shaft 5 via a mechanism for preventing the axial rotation of the portion 1 and is connected to a motor via a frame 6. Such scroll compressor portion 1 is accommodated in a casing 7.

The aforesaid orbiting scroll 2 has a base plate 21 and a spiral-shaped wrap 22 is formed on the base plate 21. The orbiting scroll 2 further has a shaft 20 on the opposite side of the base plate 21 from the wrap 22, the shaft 20 being rotatably received by an eccentric hole 50 formed in the drive shaft 5.

The aforesaid fixed scroll 3 also has a base plate 31 on which a spiral-shaped wrap 32 is formed. The fixed scroll 3 has an intake hole 30 at its periphery and a discharge hole 33 at its center.

The aforesaid frame 6 is formed such that a first main bearing 61 and a second main bearing 62 for rotatably supporting the drive shaft 5 in combination can be formed in coaxial relationship. The frame 6 further includes a thrust bearing 63 for rotatably supporting the shaft 20 formed on the back of the base plate 21 of the orbiting scroll 2, a leg portion 64 on which a motor 8 is fixedly mounted, a space 65 and an opening 66. The sole drive shaft 5 has an eccentric recess 50 at one end thereof, the eccentric recess 50 having therein a bearing 51 for rotatably supporting the shaft 20 of the orbiting scroll 2.

Also, the shaft 4 has an oil supply bore 52 longitudinally extending along the vicinity of the center of the eccentric recess 50 and opened at the opposite end to the eccentric recess 50. The shaft 5 has an oil suction port 53 made of a conical plate at the opposite end to the recess 50.

A balancer 9, inserted through the opening 66 into the space 65, is fixed to the drive shaft 5 by a bolt 10 or the like.

In this manner, the orbiting scroll 2 and the fixed scroll 3 are combined such that their wraps 22 and 32 are engaged with each other, and the orbiting scroll 2 is clamped between the fixed scroll 3 and the frame 6.

The drive shaft 5 is rotatably supported on the frame 6 via the aforesaid first main bearing 61 and second main bearing 62. The shaft 20 of the orbiting scroll 2 is inserted in the bearing 51 provided in the eccentric recess 50 of the shaft 5. The mechanism 4 for preventing axial rotation of the scroll compressor portion 1 is provided between the base plate 21 of the orbiting scroll 2 and the frame 6.

The motor 8 is fixed to the leg portion 64 of the frame 6 by bolts or the like, and the above-described compression mechanism is accommodated in the casing 7 which is formed as a sealed vessel. Also, the bottom of the casing 7 functions as an oil reservoir 70, the oil suction port 53 at the lower end of the drive shaft 5 being placed under the oil in the oil resevoir 70.

The casing 70 has an intake pipe 71 at a lower portion of the frame 6 and a discharge pipe 72 at an upper portion of the fixed scroll 1. An oil hole 54 is an oil passage through which oil is supplied to the second main bearing 62.

A space 55 is formed between the outer surface of the drive shaft 5 and the inner wall surface 67 of a bore formed in the frame 6. A thrust bearing 68 supports a thrust load imposed on the aforesaid drive shaft 5.

A balancer 81 is fixedly mounted on a lower end of a rotating rotor 80 of the motor 8. A pressure equalizing hole 69 is formed so as to pass through the frame 6, and thus the pressure level in the space 65 is equalized with that in a chamber 73 of the casing 7. Therefore, after the gas sucked into the intake pipe 71 has cooled the motor 8, the gas passes through a passage 74, sucked into an intake hole 30 of the fixed scroll 3, and compressed by the orbiting scroll 2 and the fixed scroll 3. Subsequently, the thus-compressed gas is discharged through the discharge hole 33, and then is supplied under pressure through the discharge pipe 72 to another high-pressure equipment such as a condenser.

Portions which are slidable rotated are lubricated via the oil supply port 53 provided at the end of the drive shaft 5 and placed under the oil charged in the oil reservoir 70 at a lower portion of the casing 7 and the eccentric hole 52 formed longitudinally through the shaft 5.

More specifically, the oil sucked up by a centrifugal force rises along the eccentric bore 52, and is supplied to the second main bearing 62 through the oil hole 54. After the oil has lubricated the second main bearing 62, the oil rises within the space 55 to lubricate the thrust bearing 68. Subsequently, the oil is dischared into the space 65, and thereafter drops into the oil reservoir 70 through the pressure equalizing hole 69.

On the other hand, a large percentage of oil passes by the oil hole 54 and rises further upwardly, supplied to the interior of the eccentric recess 50 formed at the upper end of the shaft 5. The oil lubricates the bearing 51 and the first main bearing 61 both of which rotatably support the drive shaft 5. Furthermore, part of the oil passes through the space 56, and is supplied to a thrust bearing 63. Thereafter, the oil passes through a back chamber 23 and the pressure equalizing hole 60, dropping into the space 65. The oil then drops back into the oil resevoir 70 together with the former oil which has completed lubricating the thrust bearing 68 and the first main bearing 61.

As described above, the scroll compressor of the present invention does not suffer from problems such as burning of the bearings which might be caused by the main bearings partially striking other adjacent components. Accordingly, it is possible to achieve remarkably smooth operation and high reliability.

The balancers can be mounted at a location which is near the member rotatable about its axis and which is suitable for the cancelling of unbalanced moment produced by the orbiting motion. Therefore, this arrangement provides a scroll compressor in which the rotational unbalance is reduced to an extremely low level. This is because (a) the first main bearing 61 and the second main bearing 62 can be coaxially formed on the sole frame 6 the (b) the balancer 9 can be easily attached to the drive shaft 5 by forming the space 65 and the opening 66 in the frame 6.

When the balancer and the drive shaft are to be incorporated in the frame, the balancer is in advance inserted through the opening formed in the periphery of the frame and is then positioned so that the balancer mounting hole coincides with the axis of the balancer. Then, a corresponding end of the drive shaft 5 is inserted in the hole of the aforesaid balancer and the first and second main bearings. After the drive shaft 5 has been inserted, the drive shaft 5 and the balancer are fixed by suitable fixing means. With this arrangement, the drive shaft is rotatably supported by the first and second main bearings, and the balancer is capable of rotating together with the drive shaft 5.

Since the frame structure of the present invention is a single frame which has an integral structure, it is possible to coaxially form the first main bearing and the second main bearing, both of which are mounted on the frame. This construction succeeds in eliminating adjustment of coaxial relationship between both of the main bearings which adjustment has heretofore been needed during assembly. Also, since the balancer can be inserted into the space of the frame through the periphery of the frame, it is possible to mount the balancer at a location where rotational balance can be easily established even in the case of an integral frame.

Figure 2A:
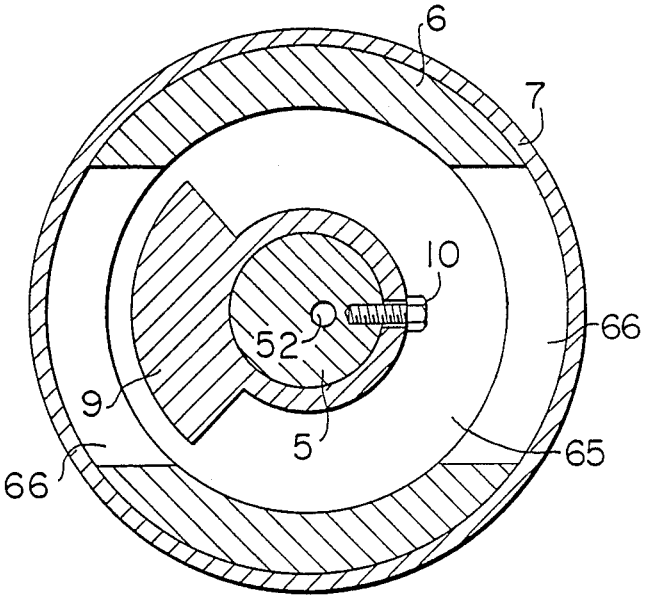
FIG. 2A is a sectional view similar to FIG. 2 but showing another embodiment which utilizes two openings at locations symmetrical to a drive shaft frame.

Although the opening 66 needs to be formed in the aforesaid frame 6 in order to incorporate the balancer 9 therein, the opening 66 may be mounted not only at a single location but also at symmetrical locations with respect to the axis as shown in FIG. 2A.

This arrangement facilitates removal of a core in a case where the frame 6 is produced by casting. Also, the opening 66 is useful in tightening the bolts 10 or the like for fixing the balancer 9 to the drive shaft 5. Incidentally, when such opening is to be formed at two locations, it is desirable that a rib is formed at an appropriate location in order to compensate for a lowering of the strength of the frame 6 per se.

In this manner, the two main bearings are formed at positions remote from each other in mutually separated but coaxial relationship in the sole frame. Therefore, it is unnecessary to perform alignment during assembly, thereby enabling a remarkable reduction in mandays.

It is a matter of course that means for fixedly mounting the balancer 9 may be adhesives, shrink fitting, welding or the like in addition to bolting.

In accordance with the present invention, the balancer is attached to the drive shaft by inserting the balancer through the opening of the frame. Therefore, the frame structure is simplified, and the first and second main bearings can be coaxially formed in the sole frame, thereby eliminating alignment which has heretofore been needed during assembly.

Figure 3:
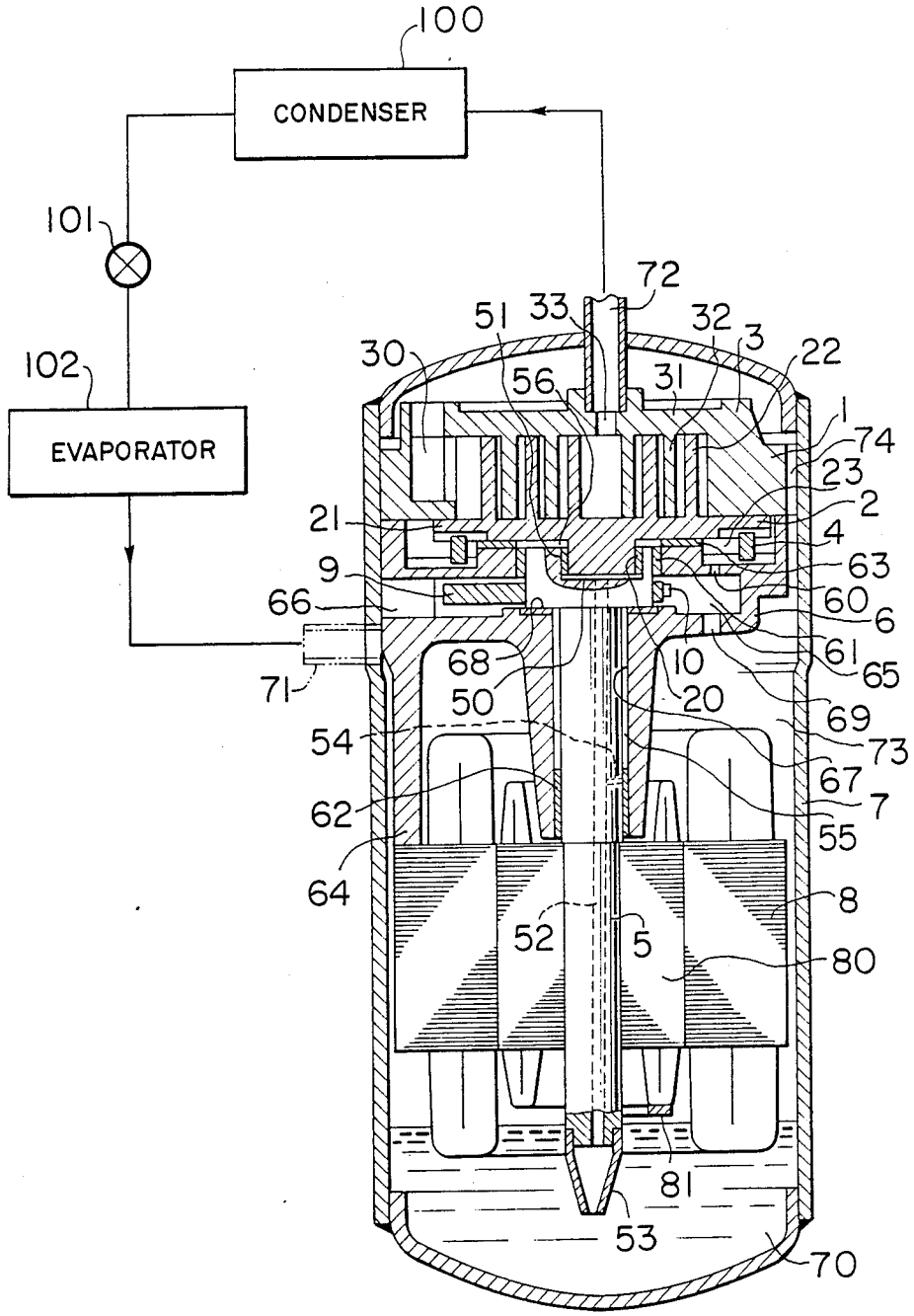
FIG. 3 is another preferred embodiment of the present invention.

FIG. 3 schematically shows a case where the present invention is applied to an air conditioner serving as a refrigeration cycle.

A condenser 100 is connected via the discharge pipe 72 to the discharge hole 33 of the scroll compressor. An expansion valve 101 is connected at its inlet to the condenser 100 and at its outlet to an evaporator 102. The outlet of the evaporator 102 communicates via the intake pipe 71 to the chamber 73 of the casing 7 of the scroll compressor. Therefore, the chamber 73 of the casing 7 communicates with the lower-pressure side of the refrigeration cycle, and thus the pressure in the chamber 73 is low. Also, since the space 65 having therein the balancer 9 communicates with the chamber 73 via the pressure equalizing hole 69, the space 65 is maintained at a low pressure. In addition, the back chamber 23 is maintained at a low pressure via the pressure equalizing hole 60. Therefore, high-temperature and high-pressure refrigerant discharged through the discharge pipe 72 is subjected to heat exchange by air or water in the condenser 100, in which, after heat dissipation, the refrigerant is condensed and liquified.

The liquified refrigerant is reduced in pressure by the expansion valve 101, formed into a low-pressure saturated gas, subjected to heat exchange by air or water in the evaporator 102, in which the refrigerant is evaporated to perform cooling action such as the cooling of air.

The gasified low-pressure refrigerant again flows into the casing 7 of the scroll compressor, and, after cooling high-temperature matter such as the motor 8, the refrigerant passes through the passage 74, sucked into the compression chamber through the intake hole 30. As described above, the scroll compressor of the present invention is suitable for use as the air conditioner serving as a refrigeration cycle.

What is claimed is:

1. In a scroll compressor including:

a scroll compressor portion including an orbiting scroll and a fixed scroll each having a base plate on which a spiral-shaped wrap is vertically formed, said orbiting scroll and said fixed scroll being combined such that said respective wraps are engaged with each other, in which orbiting motion is imparted to said orbiting scroll to cause an airtight space formed by said base plates and wraps of said respective scrolls to move toward the center of said orbiting motion to progressively reduce the volume of said airtight space thereby performing compression;

a drive shaft for connecting said scroll compressor portion and a motor; and a frame including bearings for rotatably supporting said drive shaft, said frame being disposed between said scroll compressor portion and said motor for providing fixed connection therebetween, said frame being accommodated in a casing of said scroll compressor;

the improvement comprising:

said frame constituted by a single frame on which a first main bearing portion and a second bearing portion may be formed in coaxial relationship, said single frame shaped so as to have a chamber defined therein;

a balancer mounted on said drive shaft which is rotatably supported by said first and second shaft bearing portions and between said first and second shaft bearing portions and between said first and second shaft bearing portions such that said balancer rotates within said chamber; and an opening formed in the periphery of said frame and communicating with said space-like chamber, said balancer being freely inserted and extracted through said opening.

2. A scroll compressor according to claim 1, wherein said opening formed in the periphery of said frame is disposed at two locations symmetrical with respect to the axis of said frame.

3. In a scroll compressor for an air conditioner serving as a refrigeration cycle which employs a scroll compressor including:

a scroll compressor portion including an orbiting scroll and a fixed scroll each having a base plate on which a sprial-shaped wrap is vertically formed, said orbiting scroll and said fixed scroll being combined such that respective wraps are engaged with each other, in which orbiting motion is imparted to said orbiting scroll to cause an airtight space formed by said base plates and wraps of said respective scrolls to move toward the center of said orbiting motion to progressively reduce the volume of said airtight space thereby performing compression;

a drive shaft for connecting said scroll compressor portion and a motor; and a frame including bearings for rotatably supporting said drive shaft, said frame being disposed between said scroll compressor portion and said motor for providing fixed connection therebetween, said frame being accommodated in a casing of said scroll compressor;

the improvement comprising:

said frame constituted by a single frame on which a first main bearing portion and a second bearing portion may be formed in coaxial relationship, said single frame shaped so as to have a chamber defined therein;

a balancer mounted on said drive shaft which is rotatably supported by said first and second shaft bearing portions and between said first and second shaft bearing portions such that said balancer rotates within said chamber;

an opening formed in the periphery of said frame and communicating with said space-like chamber, said balancer being freely inserted and extracted through said opening; and a pressure equalizing hole formed passing through said frame for equalizing the respective pressures in said space-like chamber, a back chamber provided at the back of said orbiting scroll, and said casing thereby providing communication between said casing and a lower-pressure side of said refrigeration cycle.

* * * * *